US008056999B2

(12) United States Patent
Gardner et al.

(10) Patent No.: US 8,056,999 B2
(45) Date of Patent: Nov. 15, 2011

(54) PRINTER WITH CONFIGURABLE MEMORY

(75) Inventors: Deane A. Gardner, Cupertino, CA (US); Andreas Bibl, Los Altos, CA (US); John C. Batterton, Los Gatos, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 793 days.

(21) Appl. No.: 12/023,483

(22) Filed: Jan. 31, 2008

(65) Prior Publication Data

US 2008/0180473 A1 Jul. 31, 2008

Related U.S. Application Data

(60) Provisional application No. 60/887,477, filed on Jan. 31, 2007.

(51) Int. Cl.
*B41J 2/07* (2006.01)

(52) U.S. Cl. ..... 347/9; 347/10

(58) Field of Classification Search ..... 347/9, 10, 347/19

See application file for complete search history.

(56) References Cited

U.S. PATENT DOCUMENTS

| | | | | |
|---|---|---|---|---|
| 5,265,315 | A | 11/1993 | Hoisington et al. | |
| 6,352,328 | B1 | 3/2002 | Wen et al. | |
| 7,631,962 | B2 * | 12/2009 | Bibl et al. | 347/87 |
| 2004/0189732 | A1 | 9/2004 | Usuda | |
| 2005/0104921 | A1 | 5/2005 | Watanabe et al. | |
| 2007/0013736 | A1 * | 1/2007 | Higginson et al. | 347/37 |
| 2007/0057979 | A1 | 3/2007 | Gardner et al. | |
| 2008/0020573 | A1 | 1/2008 | Birkmeyer et al. | |

OTHER PUBLICATIONS

International Search Report and Written Opinion of the International Searching Authority, International Application Serial No. PCT/US2008/052613, Jun. 25, 2008, 9 pp.

Dimatix, Inc., "Plastics Electronics Conference, Frankfurt, Germany, Oct. 4, 2005", [retrieved on Jul. 2, 2008]. Retrieved from the Internet: <URL: http://www.dimatix.com/files/PlasticElectronicsConferenceOctober2005.pdf>, 22 pp.

* cited by examiner

*Primary Examiner* — Huan Tran
(74) *Attorney, Agent, or Firm* — Fish & Richardson P.C.

(57) ABSTRACT

A printer is described that has a configurable memory to which waveform definitions are uploaded just prior to a printing process. The printer manufacturer can program a printer controller with waveforms that have been created by the printer manufacturer, instead of waveforms pre-programmed by the printhead manufacturer.

20 Claims, 11 Drawing Sheets

PRINTER WITH CONFIGURABLE MEMORY

CROSS-REFERENCE TO RELATED APPLICATIONS

This application claims priority to U.S. Provisional Application Ser. No. 60/887,477, filed on Jan. 31, 2007. The disclosure of the prior application is considered part of and is incorporated by reference in the disclosure of this application.

BACKGROUND

The following disclosure is directed to systems that eject fluid droplets.

In various industries it is useful to deposit a fluid in a controllable manner onto a substrate by ejecting droplets of the fluid from a fluid ejection module. For example, ink jet printing uses a printhead to produce droplets of ink that are deposited on a substrate, such as paper or transparent film, in response to an electronic digital signal, to form an image on the substrate.

An ink jet printer typically includes an ink path from an ink supply to a printhead that includes nozzles from which ink drops are ejected. Ink drop ejection can be controlled by pressurizing ink in the ink path with an actuator, such as, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media are moved relative to one another. A high performance printhead may have several hundred nozzles, and the nozzles may have a diameter of 50 microns or less (e.g., 25 microns), may be separated at a pitch of 100-300 nozzles per inch, and may provide drop sizes of approximately 1 to 70 picoliters (pl) or less. Drop ejection frequency is typically 10 kHz or more.

A printhead can include a semiconductor body and a piezoelectric actuator, for example, the printhead described in Hoisington et al., U.S. Pat. No. 5,265,315. The printhead body can be made of silicon, which is etched to define ink chambers. Nozzles can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber that communicates with a nozzle, and an ink drop is formed.

Fluid drop formation typically is altered by adjusting the waveform parameters such as voltage amplitude, duration of the voltage pulse, slope of the waveform, number of pulses, and other adjustable parameters of the drive pulse delivered to the piezoelectric actuator. The optimal waveform parameters for different fluids vary depending on a particular fluid's physical properties. Typically, the optimal waveform parameters for a specific fluid are determined empirically.

SUMMARY

In one aspect, an assembly of components is described that includes a circuit board support, a circuit board comprising electronic logic mounted on the circuit board support, wherein the electronic logic is configurable to receive a definition of waveform and a printhead for printing on a substrate, wherein the printhead has actuators that are actuatable according to instructions received from the electronic logic that are based on the definition of the waveform, wherein the assembly does not include a substrate support.

In another aspect, an assembly of components is described that includes a circuit board support, a circuit board comprising electronic logic mounted on the circuit board support, wherein the electronic logic is configurable to store a plurality of definitions of waveforms and a printhead for printing on a substrate, wherein the printhead has actuators that are actuatable according to instructions received from the electronic logic that are based on the definition of the waveform.

In yet another aspect, a method of forming a printer is described. A support, a circuit board comprising a configurable memory and a printhead are received, wherein the configurable memory is configurable to store a definition of a waveform, and the support is configured to have the circuit board and the printhead mounted thereon. One or more waveforms are loaded onto a master memory. After the one or more waveforms are loaded onto the master memory, an assembly comprising the support, master memory, circuit board and printhead is enclosed within a housing so that the master memory is able to be in communication with the configurable memory and the configurable memory is able to be in communication with the printhead.

In another aspect, a computer program product, encoded on a tangible program carrier, operable to cause data processing apparatus to perform operations is described. The operations include providing a representation of a jetting waveform, receiving input indicating a selection of a portion of the jetting waveform, receiving input indicating a modification of the portion of the jetting waveform selected, modifying the jetting waveform according to the input indicating a modification, adding a modified version of the jetting waveform to a lookup table and transmitting the lookup table to storage.

In yet another aspect, a computer program product, encoded on a tangible program carrier, operable to cause data processing apparatus to perform operations is described. The operations include providing a representation of a jetting waveform, receiving input indicating a selection of a portion of the jetting waveform, receiving input indicating a modification of the portion of the jetting waveform selected, and modifying the jetting waveform according to the input indicating a modification.

Implementations of the systems and methods described herein may include one or more of the following features. The assembly can includes four printheads, each printhead having a plurality of nozzles and being configured to contain a single ink. The assembly can include six printheads, each printhead having a plurality of nozzles and being configured to contain a single ink. The support can comprise alignment features for aligning the assembly in a deposition device. The assembly can include a plate to which the printheads are fastened, wherein the plate is removably secured to the support. The method can include receiving a waveform and modifying the waveform to be used to jet a desired fluid to create a custom waveform, wherein loading the one or more waveforms onto a master memory comprises loading the custom waveform onto the master memory. Receiving input indicating a modification of the portion of the jetting waveform can comprise receiving input indicating a change in drive voltage. Receiving input indicating a modification of the portion of the jetting waveform can comprise receiving input indicating a change in voltage pulse duration. Receiving input indicating a modification of the portion of the jetting waveform can comprise receiving input indicating a change in slope of the portion of the waveform. Instructions can be sent to a printer, wherein the instructions determine actuation of a printhead.

Advantages of the methods and systems described herein may include one or more of the following. A graphical user interface (GUI) tool for enabling a user to modify waveforms can facilitate faster and simpler tailoring of waveforms for new fluids to be jetted. An assembly that includes a support with a controller and printheads mounted thereon can be received by a printer manufacturer and provide a ready-to-install component in a deposition device. The printer manufacturer can use the GUI tool to create waveforms to be used with the printheads received from a printhead manufacturer. The printer manufacturer can then load the waveforms that have been created onto a memory for driving the printheads received from the printhead manufacturer. This provides the printer manufacturer with more flexibility in programming their deposition devices for use with new and different printing fluids. Further, the printer manufacturer need not rely on the printhead manufacturer to create and program the waveforms for the printer manufacturer. This can reduce the cost and time it takes to modify and update a deposition device to make the deposition device a useful tool for a greater number of users and applications. With the GUI tool, the time it takes to modify and create new waveforms for printing can be reduced even further.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A tremendous variety of liquids with different material compositions are available, and the number of such liquids continues to increase as new materials and compositions are investigated. A printer manufacturer can program a printer, or a deposition system, to optimize droplet ejection conditions for deposition of a particular liquid.

In addition, a printer manufacturer can build a printer from components supplied by other entities. For example, the printer manufacturer can purchase a printhead from a printhead manufacturer and build a printer around the printhead. Such a printer manufacturer can be an Original Equipment Manufacturer, or OEM. The OEM can customize the printer for use with particular liquids that are to be deposited, the substrate on which the fluid is to be deposited, the volume of the droplets to be ejected and the environmental conditions in which deposition is to occur, all of these factors being referred to as the printing conditions for short.

During printing, instructions specific to the printhead and the printing conditions are sent to the printhead to cause ejection to occur and to create an image according to image data. The instructions include, in part, waveforms and in some cases printhead temperature. In some printers, during printing the instructions are sent from the memory, or primary controller, to a printhead controller which then controls the printhead, to set the operating conditions for fluid ejection. In the systems described herein, the OEM is able to create the instructions. Once the instructions have been created, the OEM can load the instructions onto a memory for installing into a printer. The memory can include a lookup table with many different waveforms, portions of waveforms and/or printhead temperatures that are programmed by the OEM for printing under specific printing conditions. Described herein are the methods that can be used by the OEM to create the instructions, the parts that the OEM can use to assemble the printer and the function of the printer that is created by the OEM to be sold to an end user.

Figure 1:
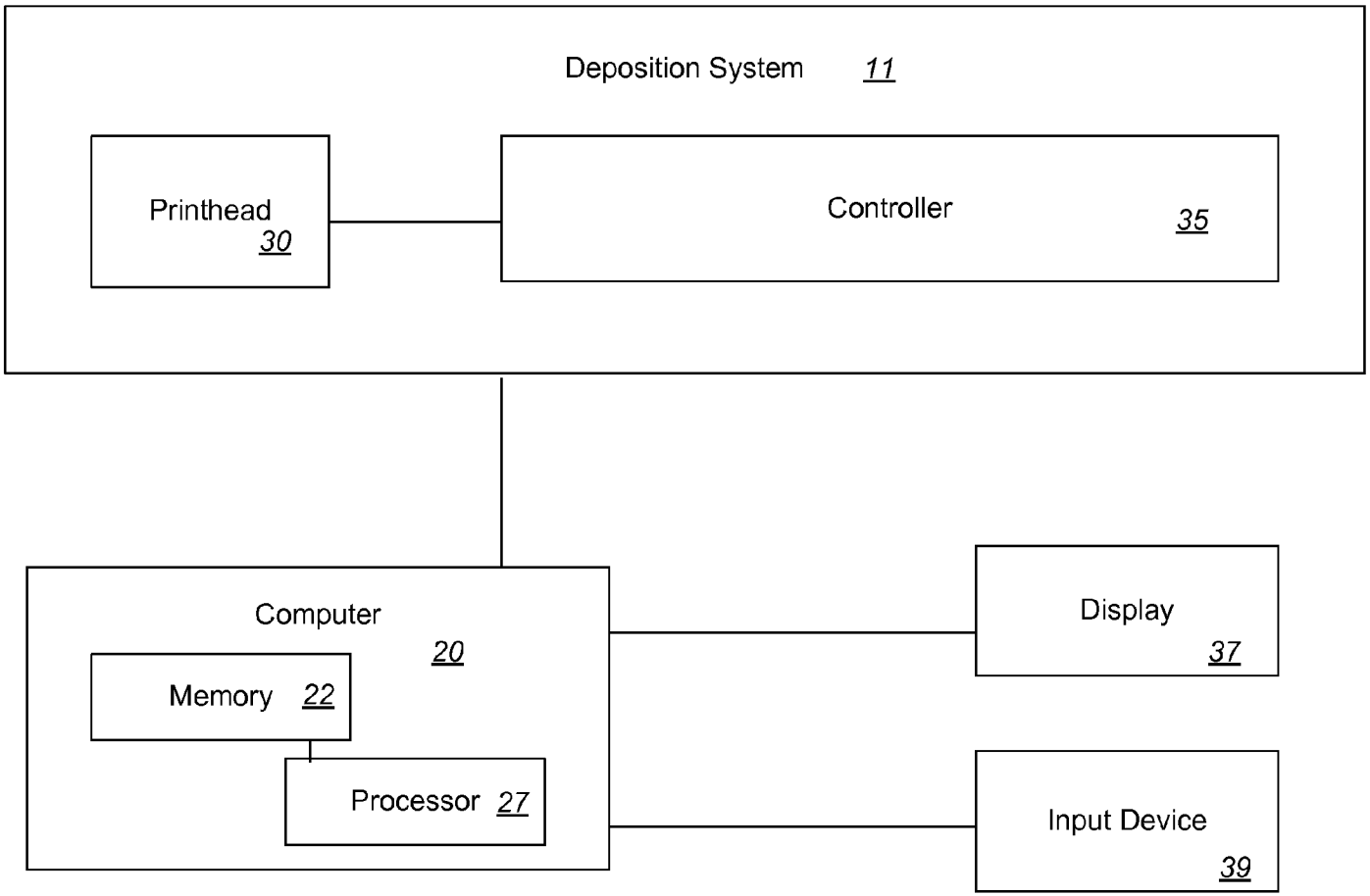
FIGS. 1 and 2 are block diagrams of deposition devices.

Referring to FIG. 1, a block diagram represents a deposition system 11 having a printhead 30 and a controller 35 for controlling the printhead 30. The controller 35 and printhead 30 can be within a housing. In this implementation, the fluid deposition system 11 is coupled to a computer 20. The computer 20 can be connected to or include a display 37 (e.g., a monitor) and a user input device 39 (e.g., a keyboard, mouse or joystick). The computer 20 can include a memory 22 and a processor 27. The user can input information, such as a type of fluid for printing and a substrate to be printed onto, into the computer 20 using the input device 39. The processor 27 can use the input information to determine the waveform that is best suited for the user's printing fluid and substrate. In some embodiments, the processor 27 also provides a waveform definition to the controller 35.

Figure 2:
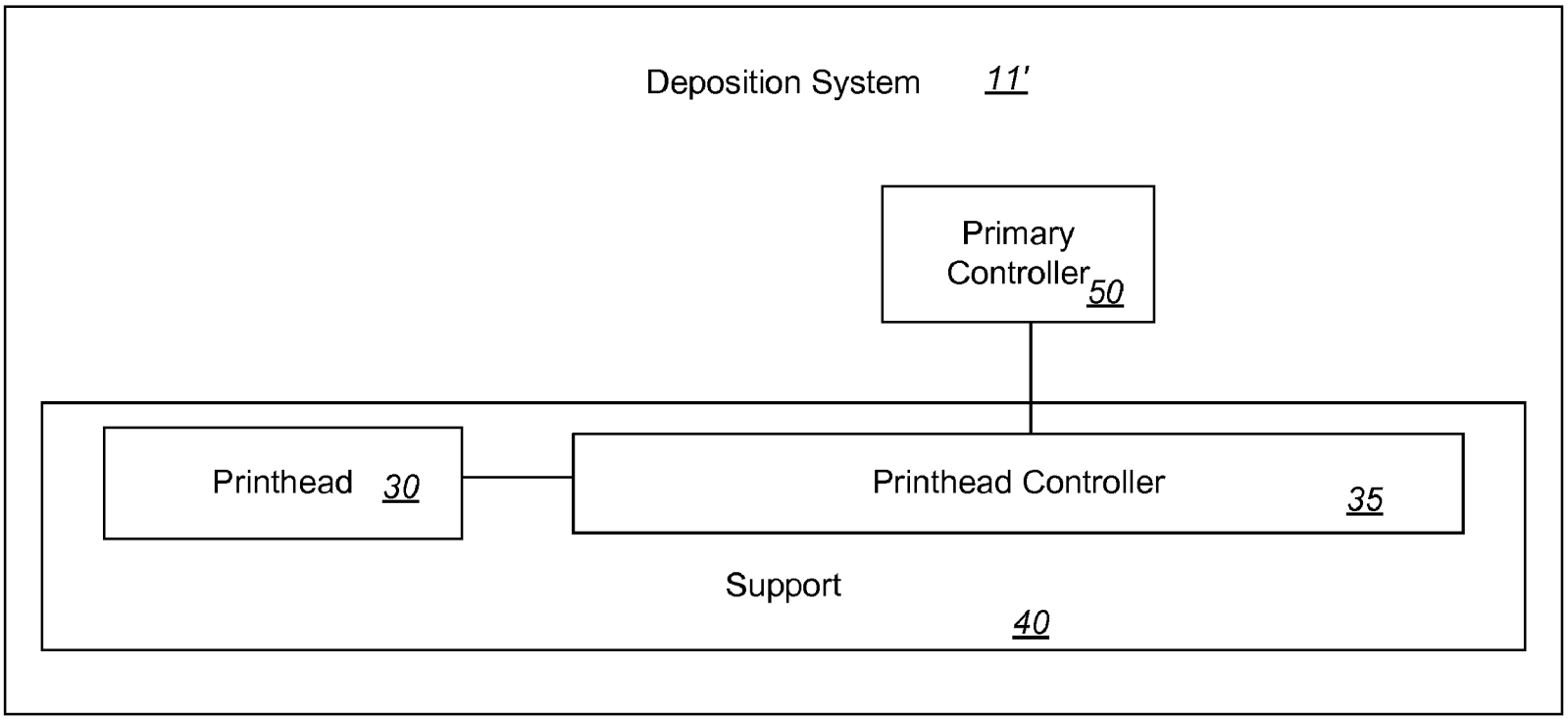

Referring to FIG. 2, another embodiment of the deposition system 11' is shown. The deposition system 11' includes a support 40 for supporting the controller 35 and printhead 30. The deposition system 11' also includes a primary controller 50 that is configured to communicate with the printhead controller 35. Primary controller 50 can have at least a CPU with attached memory. The primary controller 50 controls the higher level functions of the printer, can provide a user interface, control paper motion, communicate with an external source of printable image data, etc. Printhead controller 35 furnishes lower-level control and/or monitoring of printhead 30, including generation of drive waveform signals and/or closed-loop control of the printhead temperature. Various modifications can be made to the deposition devices shown in FIGS. 1 and 2, such as adding a display to the device. Additionally, other components, such as a platen configured to support a substrate during a print operation, a cartridge mount assembly for translating the printhead 30 and other suitable components can be included in the deposition device.

Figure 3:
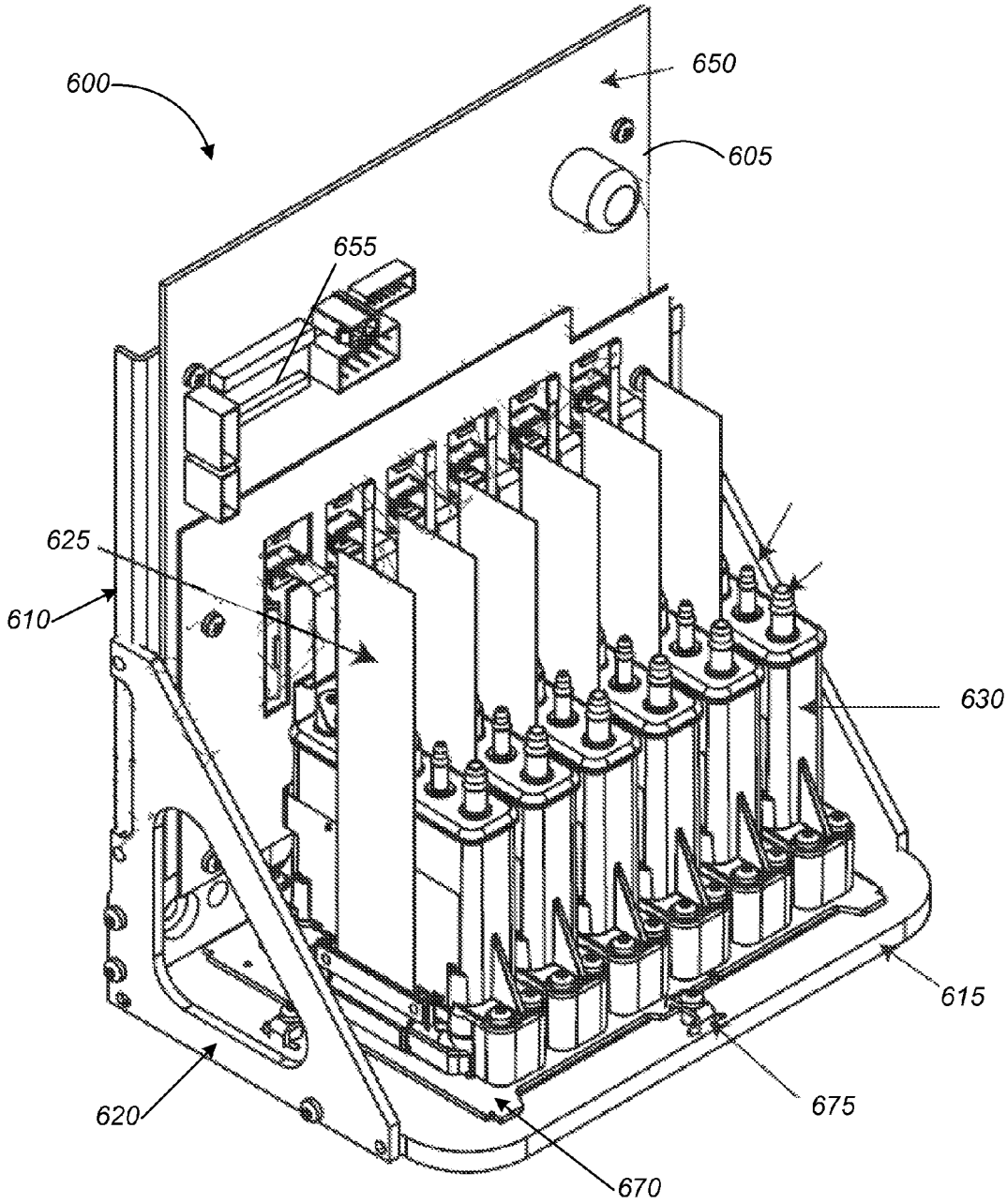
FIG. 3 is a perspective view of a mounting assembly.
Figure 4:
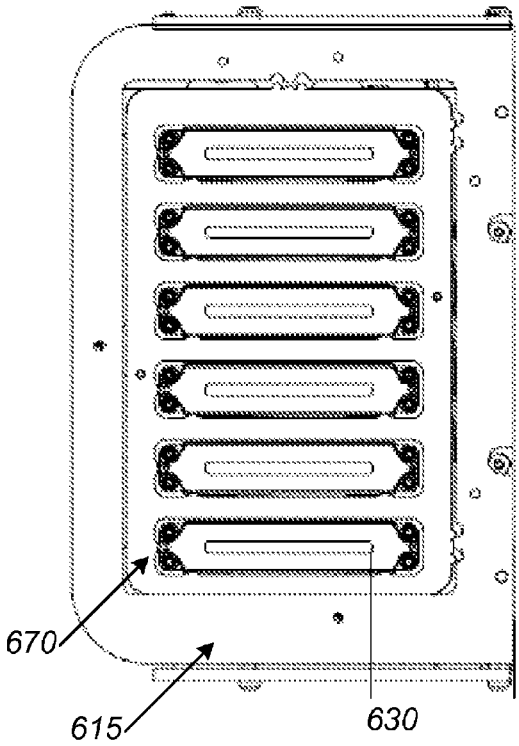
FIG. 4 is a bottom view of a mounting assembly.

Referring to FIG. 3, a mounting assembly 600 can be within the deposition system 11. The mounting assembly 600 can include a support 605. The support 605 can be configured to hold printheads 630 with ink reservoirs and a printhead controller 650. The support 605 supports six printheads, but can be configured to support more printheads, such as twelve, or fewer printheads, such as one, two, three, four or five. In some embodiments, each printhead is configured to have a plurality of nozzles. In some embodiments, each printhead only contains a single ink. Thus, to produce a multicolored image, multiple printheads may be used in a deposition device. A suitable printhead is described in U.S. application Ser. No. 11/256,669, filed on Oct. 21, 2005, which is incorporated herein for all purposes. In some embodiments, the support 605 has a vertical back plate 610, a horizontal bottom plate 615 and a side bracket 620 that stabilizes the vertical back plate 610 and a horizontal bottom plate 615. The vertical back plate 610 and the horizontal bottom plate 615 may be in orientations other than those described. In some embodiments the vertical back plate 610 is at a right angle to the horizontal bottom plate 615. The horizontal bottom plate 615, as shown in FIG. 4, has an opening for exposing the nozzles of the printheads 630 to the environment in which a substrate is located. That is, the bottom plate 615 has an opening so that liquid ejected from the nozzles is free to travel along a flight path to a substrate. In some embodiments, an assembly does not include a substrate support.

Referring back to FIG. 3, the mounting assembly 600 supports a printhead controller 650. The printhead controller 650 can be fastened to the mounting assembly 600, such as to the vertical back plate 610. Fasteners, such as clips, screws, epoxy, rivets or other suitable fastening devices can be used to hold the controller to the mounting assembly 600.

The printhead controller 650 is in electrical communication with the printheads 630. The printhead controller 650 has a configurable memory that is configurable to store one, or a plurality, of definitions of waveforms. The definitions of the waveforms are essentially numeric values that indicate a specified voltage to be applied at a specified time. In some embodiments, the definitions of the waveforms include instructions to only drive an individual printhead jet with a portion of a waveform. At printing, the printhead controller 650 sends electrical signals to the printheads 630 to actuate each individual jetting element and cause fluid to be ejected from the associated nozzle as desired. In some embodiments, the configurable memory is volatile and the definitions of the waveforms are cleared from the configurable memory each time power to the configurable memory is shut off. The printhead controller 650 includes a connector 655 for connection to a primary controller. The primary controller stores the waveforms, which are sent as definitions of the waveforms to the printhead controller 650 through the connector 655. The connector 655 can be a 50 pin connector or other suitable type of connector for coupling together two components and transmitting data. Formatted image data from the primary controller can also be sent to the printhead controller 650 through connector 655.

Figure 5:
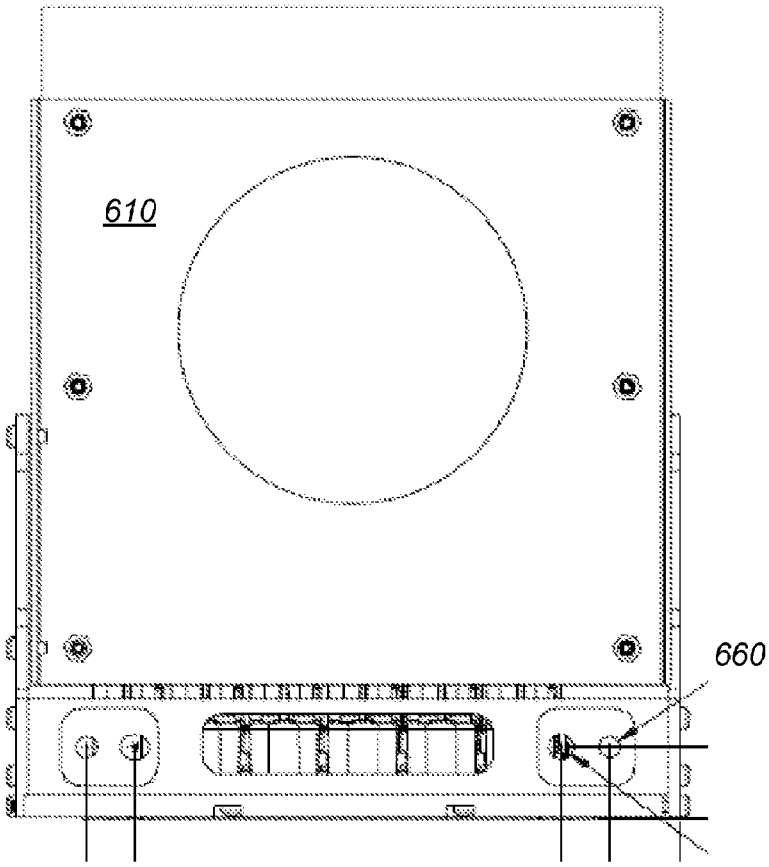
FIG. 5 is a backside view of a mounting assembly.

Referring to FIG. 5, in some embodiments, the mounting assembly 600 has alignment features 660 for aligning the mounting assembly 600 within a deposition device. The alignment features 660 can be a series of pins, recesses, hooks or other devices for ensuring that the mounting assembly 600 is in the proper location and orientation within the deposition device. As shown, alignment features 660 are at either end of the mounting assembly 600, which can prevent skewing of the assembly within the device. Alignment features 660 can be located not only on the vertical back plate 610, but also or alternatively on the horizontal bottom plate 615 or the side bracket 620 (FIG. 3).

Figure 6:
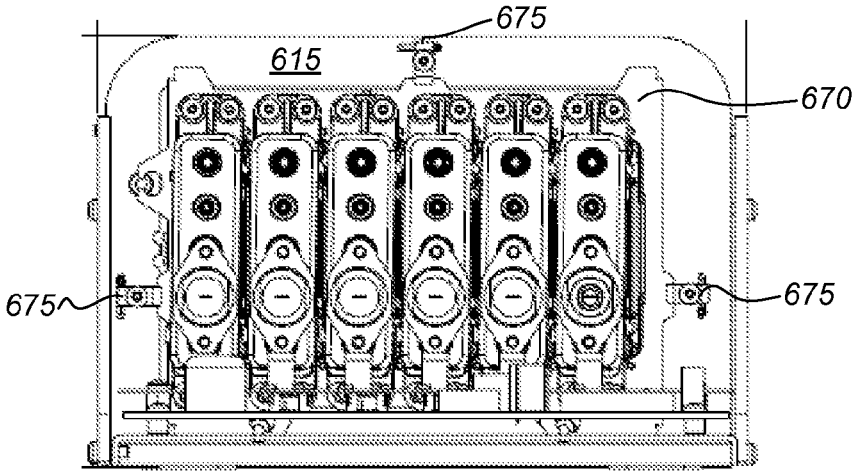
FIG. 6 is a plan view of a mounting assembly.

Referring to FIG. 6, the printheads 630 with ink reservoirs are removably attached to the mounting assembly, so that if a printhead 630 requires replacement, the printhead 630 can be removed and replaced with a new printhead. In some embodiments, the printheads 630 are mounted on a printhead plate 670 that can be removed from the mounting assembly 600. The mounting assembly 600 can include a fastener 675, such as a spring clamp, in the horizontal bottom plate 615 which allows the printhead plate 670 to be released from the assembly. In some embodiments, the fasteners do not allow for any movement of the printhead plate 670 after fastening. This can prevent the printheads from slipping out of alignment after being registered to the proper location. The fasteners 675 can be located on the top of the horizontal bottom plate 615 toward the two ends of the plate, that is, adjacent to the side brackets 620, and on the horizontal bottom plate 615 toward the front of the base plate, that is, furthest from the controller 650. Printhead plate 670 may include tabs, bumps, slots, clips or other features which precisely locate the printheads 630 in relation to one another on the plate 670. The alignment features can provide adequate color-to-color registration of the final printed image, without requiring manual alignment of each printhead's relative position.

The deposition systems described above can be manufactured in a number of stages and can be manufactured and assembled by different entities. For example, a printhead manufacturer may supply a printhead to a printer manufacturer who assembles a deposition device. The printhead manufacturer may optionally supply a controller that communicates with the printhead during printing. For ease of placement in a deposition system, the printhead manufacturer can supply a support holding a printhead, or multiple printheads, along with the controller. A kit, such as the mounting assembly described herein, including a support, a number or variety of printheads and the controller can be received by the manufacturer ready for installation into a deposition device.

The printer manufacturer may manufacture inks or other deposition fluids to be used with the deposition device. Because of the unique characteristics of each type of fluid, such as viscosity and surface tension, and the unique characteristics of the printheads, such as the resonance of the pumping chamber and nozzle orifice size, a particular waveform may be optimal for causing the printhead to eject the fluid as desired. Different sizes of droplets may also be ejected when different waveforms are used to drive the printheads. In additional, printing onto different substrates can require different printing conditions.

The printer manufacturer can configure the waveforms that are delivered to the printhead to optimize the ejection of each type of fluid that is recommended for use with the deposition system. Because the printer manufacturer, and not only the printhead manufacturer, has the freedom to create and program new waveforms for driving the printheads, the printer manufacturer can add value to the deposition system in a short period of time without requiring input from the printhead manufacturer. The controller provided by the printhead manufacturer operates on an open platform, rather than a proprietary language. This allows the printer controller, developed and/or programmed by the printer manufacturer, to communicate with the configurable memory on the printhead controller, thus setting the operating parameters for each printhead.

Figure 7:
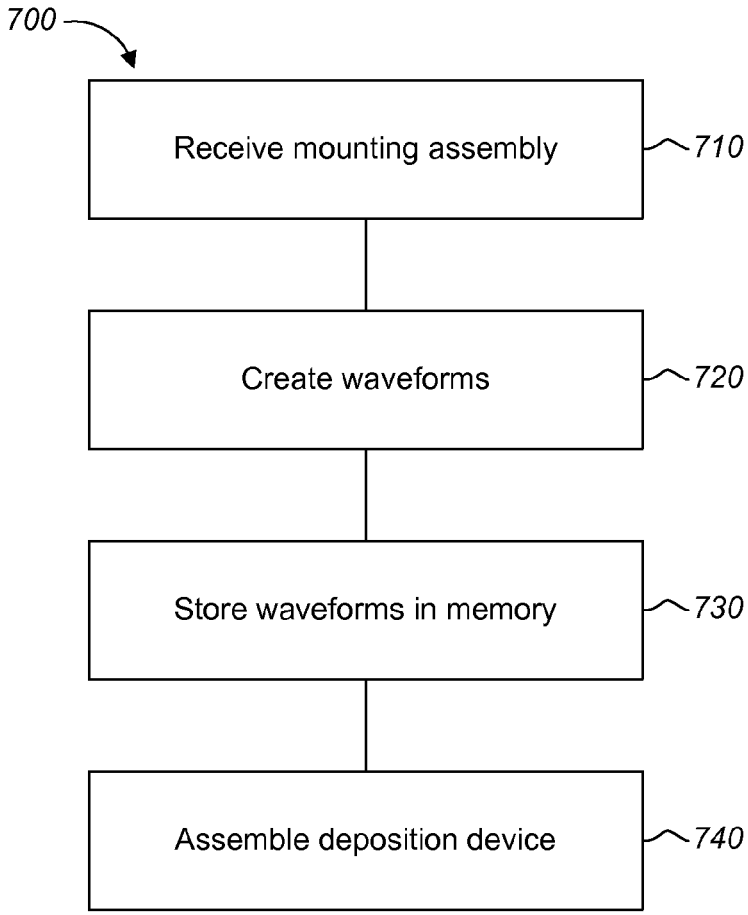
FIG. 7 is a flow chart describing formation of a deposition system.

Referring to FIG. 7, a method 700 of assembling a deposition device is described. A printer manufacturer receives a mounting assembly, ready for installation into a deposition device (step 710). The mounting assembly can be shipped as a unit or as individual components that are then assembled at the manufacturer. The printer manufacturer can create waveforms for driving the printheads on the mounting assembly (step 720). In addition to the waveform parameters that can be set and adjusted, the printhead temperature can also be programmed according to the setting that achieves the desired jetting results. The printer manufacturer can create the waveforms or select the portions of the waveforms to be used during printing at any time in the printer product development cycle, or even after the product has been installed at the end-user facility, through software upgrades.

The waveforms are stored in a primary controller which includes memory, such as RAM, for example, flash memory, or other suitable memory (step 730). In some embodiments, the manufacturer creates a number of waveforms and/or selects different portions of waveforms suitable for different printing conditions. If there is more than one waveform or more than one portion of a waveform to be used to eject droplets, a lookup table can be created and stored in the primary controller to allow the controller to select the correct waveform or waveform segment for printing. In addition, the lookup table can store the printing temperature for specific printing conditions. The printer manufacturer can program the lookup table with the waveforms, portions of waveforms and temperatures with their corresponding printing conditions.

The printer manufacturer assembles a deposition device with the mounting assembly, primary controller with the stored waveforms and other necessary components in a housing to form the deposition device (step 740). In assembling the deposition device, the primary controller with the stored waveforms is placed in communication with configurable memory on the printhead controller.

The deposition device created by the printer manufacturer can operate in the following manner. A user selects the type of fluid to be deposited onto a substrate. In some instances, the user also inputs the type of substrate on which the fluid will be deposited. An image is then selected. Based on the printing fluid, the substrate material, and possibly the image, text or pattern, to be printed, the waveform and temperature that is appropriate for jetting the fluid is determined. If the primary controller programmed by the manufacturer has a number of waveforms, the desired waveform or waveforms can be selected from a lookup table.

A definition of the waveform is sent from the primary controller to the configurable memory on the printhead controller circuit board. The configurable memory can store one or a plurality of waveforms at one time. In some instances, the desired waveform changes during printing. For example, if consecutively printed droplets are of different sizes, the waveform that is required for ejecting each droplet or the portion of the waveform that is used for printing each droplet can be different. In these cases, each of the waveform definitions are stored on the configurable memory during printing. The definition of the waveform is then used to actuate the individual jetting elements of each printhead.

As noted, the printer manufacturer programs the deposition device for use with one or more fluids for ejection by the deposition device. However, before the manufacturer programs the deposition device, waveforms that cause the device to properly eject the fluid need to be determined. The manufacturer can use waveforms that are operable for ejecting similar type fluids from a similar printhead. However, it may be desirable to tailor the waveforms to the specific fluid to be ejected. Additionally, some types of fluids need to be tested with the printhead and new waveforms need to be developed because of the unique properties of the fluid.

A typical liquid that may need to be tested is ink, and for illustrative purposes, the techniques and droplet ejection modules are described below in reference to a printhead module that uses ink as the liquid. However, it should be understood that other liquids can be used, such as electroluminescent or color filter material used in the manufacture of displays, metal, semiconductor or organic materials used in circuit fabrication, e.g., integrated circuit or circuit board fabrication, and organic, biological, or bioactive materials, e.g., for drugs or the like.

In order to test an ink to develop a waveform for ejecting the ink, a deposition system, such as that described in U.S. application Ser. No. 11/532,473, filed Sep. 15, 2006, which is incorporated herein by reference for all purposes, can be used to assist the manufacturer in modifying or creating a waveform.

Figure 8:
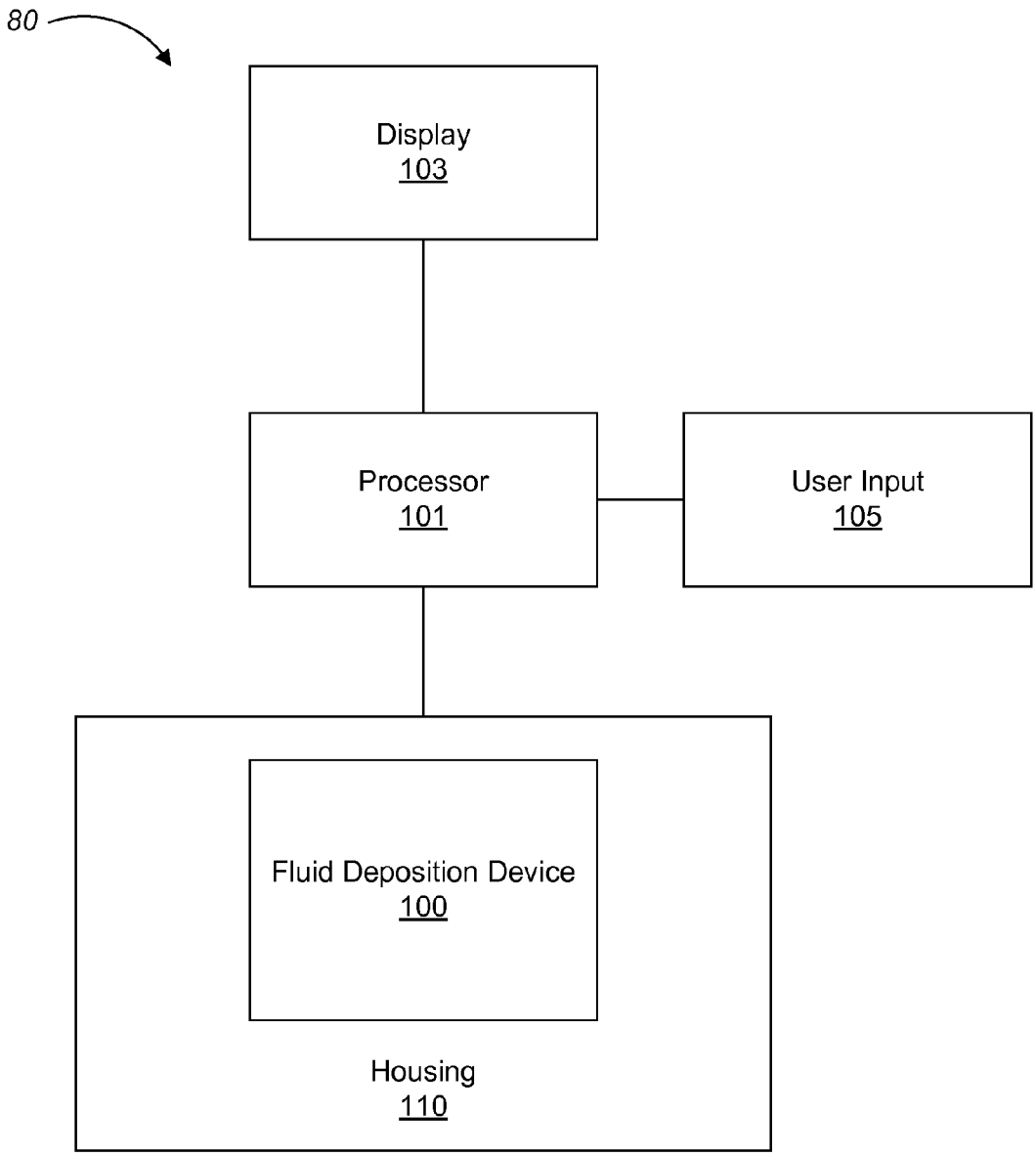
FIG. 8 is a block diagram of a programming system.

A programming system 80 can be substantially as represented in FIG. 8. A block diagram representation of a programming system 80 comprising, optionally, a fluid deposition device 100 within a housing 110 is shown. In this implementation, the fluid deposition device 100 is coupled to a processor 101. The processor 101 can be connected to a display 103 (e.g., a monitor) and a user input device 105 (e.g., a keyboard and/or mouse). The processor 101 can provide instructions to various components of the fluid deposition device 100, as shall be described further below. The display 103 and user input device 105 can allow a user to input operation parameters and make adjustments to a fluid deposition process, as well as view feedback provided by the processor 101, as described further below.

Figure 9:
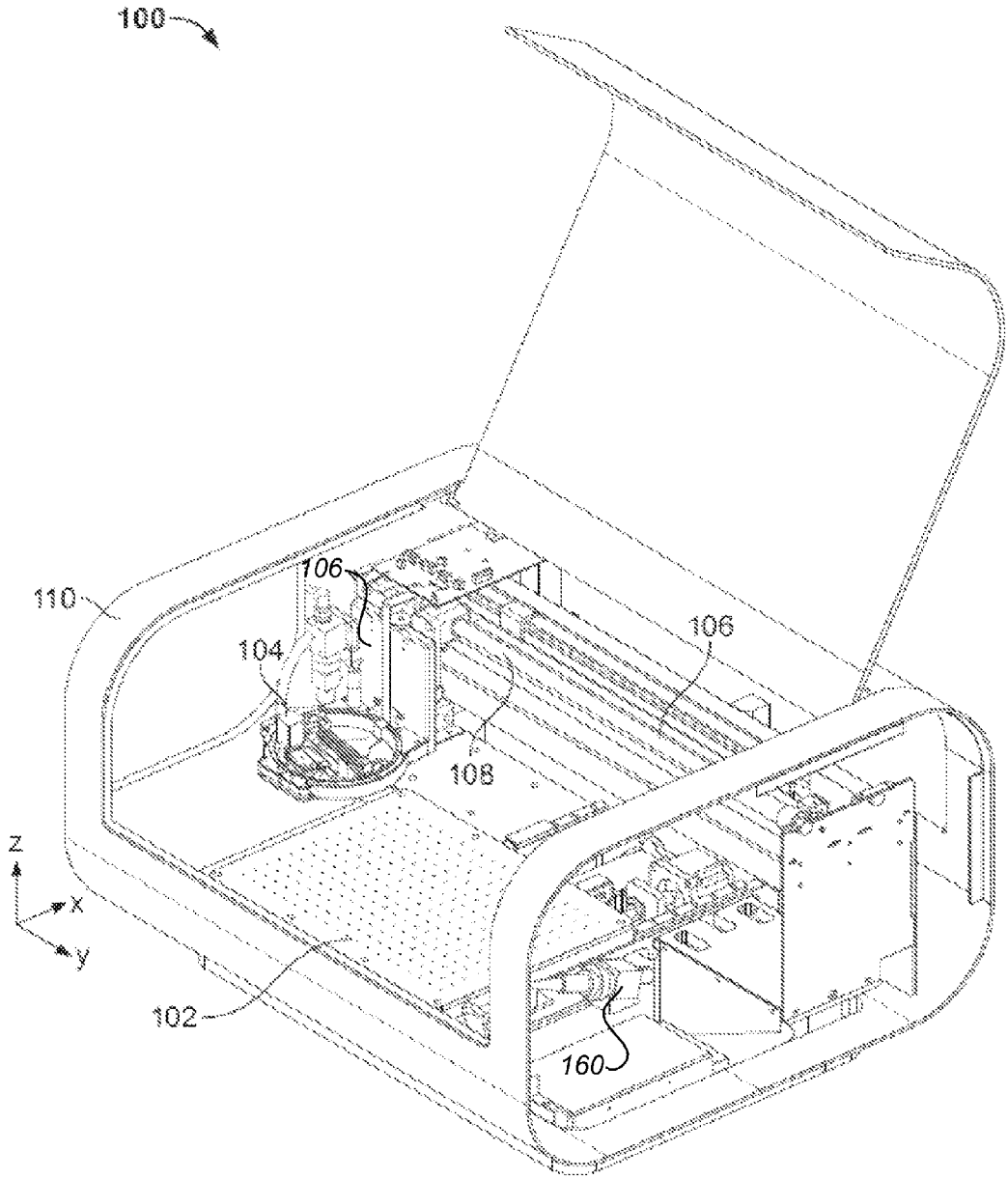
FIG. 9 is a representation of an exemplary programming system.

Referring to FIG. 9, an exemplary fluid deposition device 100 can include a platen 102 configured to support a substrate during a print operation. A cartridge mount assembly 104 is attached to a frame 106 and positioned above the platen 102. The cartridge mount assembly 104 can translate along a rail 108 in the y-direction, providing movement relative to a substrate positioned on the platen 102. Additionally, the cartridge mount assembly 104 can move upward and downward relative to the platen 102, i.e., in the z-direction, to provide relative vertical movement between a print cartridge mounted therein and the substrate.

In addition, a drop watcher camera system 160 can be mounted to one side of the platen 102. The camera system 160 allows a user to watch fluid drops as they exit the print cartridge (not shown) and are printed on a substrate positioned in front of the camera system 160. By strobing a light slightly out of phase with the nozzle firing, a series of pictures of a series of fluid drops in flight between the nozzle and the substrate can be obtained. A composite of the series of pictures viewed together can give the illusion of a video clip of a single drop being ejected from a nozzle: in reality, the "video" is actually a composite of a series of still pictures taken of many different drops at slightly different stages of formation and flight. The strobed images can be averaged together to obtain a resultant image or alternatively, each individual image frame can be analyzed to obtain various drop characteristics.

In some implementations, a high speed video camera is implemented to capture real time video images of the fluid drops being ejected through one or more nozzles in the print cartridge. A high speed video camera can be equipped with a charge-couple device (CCD), complementary-symmetry/metal-oxide semiconductor (CMOS) or other suitable image sensors. A CCD camera can capture images at speeds of up to 1000 frames per second, and this can be increased to 1,000,000 frames per second by adding an image intensifier. An image intensifier is a device that amplifies visible and near-infrared light from an image to facilitate a dimly lit scene to be viewed by a camera. A CMOS sensor can be more cost effective than a CCD sensor and easier to integrate with on-chip memory and processing functions. A CMOS sensor can capture images at speeds of up to 1000 frames per second. Other image sensors capable of similar or higher frame rates can be implemented. The real time video images of the fluid drops can be used to capture various drop characteristics of the fluid drops in various stages of formation and flight. The drop characteristics can be analyzed to provide feedback information to adjust the waveform characteristics of the drive pulse delivered to the print head. The adjustments can be performed automatically or manually by a user.

Referring back to FIG. 8, the display 103 can show a graphical representation of a waveform corresponding to the drive pulse provided to an actuator in a print cartridge in the fluid deposition tool 100 to fire ink out nozzles. A user can view the waveform and make adjustments as desired using the user input device 105. For example, the user can adjust the drive voltage delivered to the printhead within the print cartridge, duration of the voltage pulse, slope of the waveform, number of pulses, and other adjustable parameters. The parameters can adjust not only the width and height of the voltage pulse, but also affect the drop size, optimize reliabilty and speed of drop deposition. The user input is used by the processor 101, e.g., by a software application executing in the processor 101, to adjust the signals sent to the actuator or actuators located within the print cartridge.

In addition, the software application can include a graphical user interface (GUI) comprising multiple interfaces corresponding to one or more deposition system functions. The GUI includes a print setup interface to facilitate the selection of cartridge settings. Once the cartridge setting is selected by the user, the jetting process can be initiated based on the selected print pattern, substrate settings, and the cartridge settings.

Figure 10:
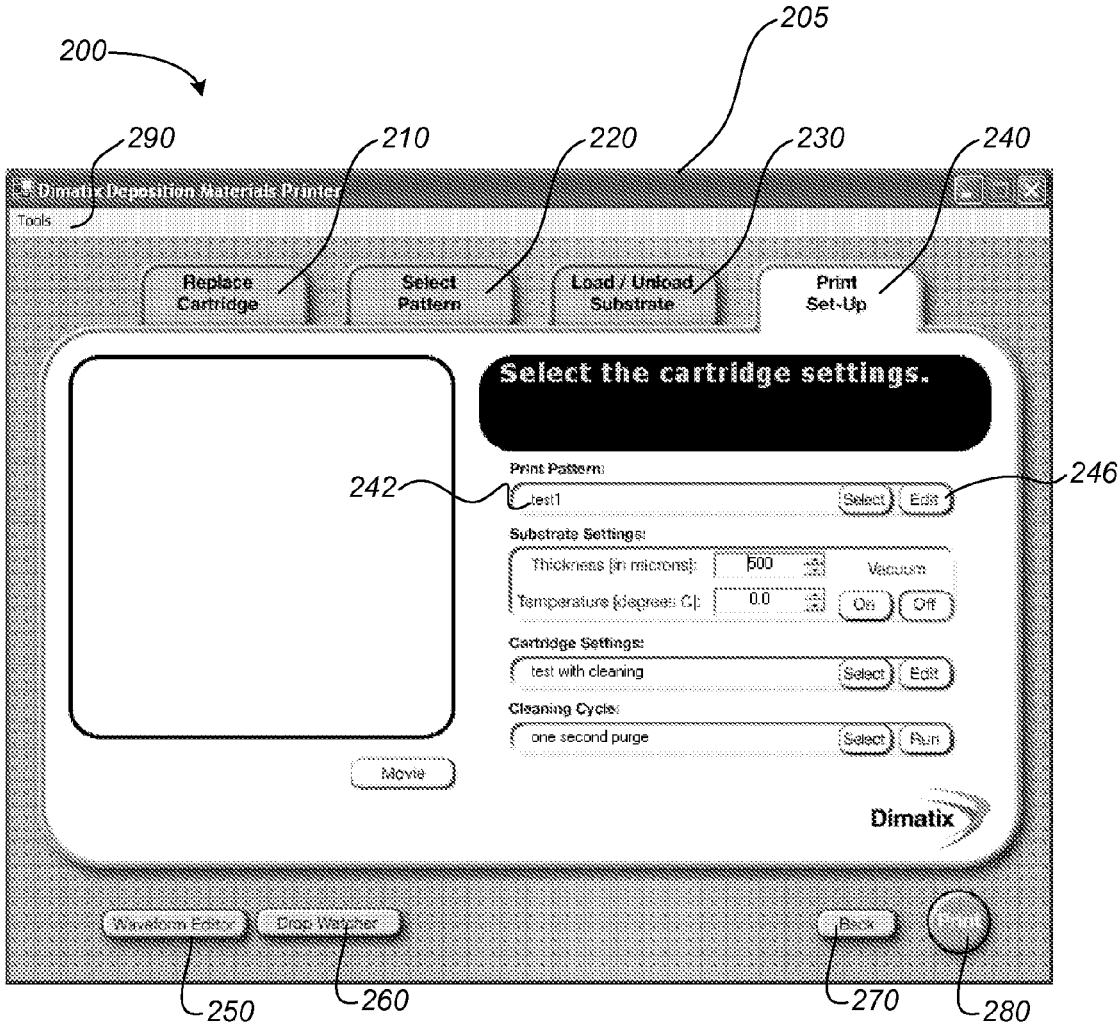
FIG. 10 is a representative screenshot of a Print Set-Up interface.

Jetting of a fluid having specific composition and fluid characteristics can require customization of the cartridge settings. FIG. 10 is a screenshot of one implementation of the GUI 200 comprising an interface window 205 including multiple interfaces accessible through user selection of GUI tabs (tabs Replace Cartridge 210, Select Pattern 220, Load/Unload Substrate 230, and Print Set-Up 240), buttons (Waveform Editor 250, Drop Watcher 260, Back 270, and Print 280), and menus 290. In alternate implementations, other GUI components in addition to or in place of the GUI tabs (210, 220, 230, and 240), buttons (250, 260, 270, and 280), and menu button 290 can be used. In the implementation represented in FIG. 10, the user can select an edit button 246 placed next to a cartridge settings selection window 242 to launch a cartridge settings editor 300, as shown in FIG. 11.

Figure 11:
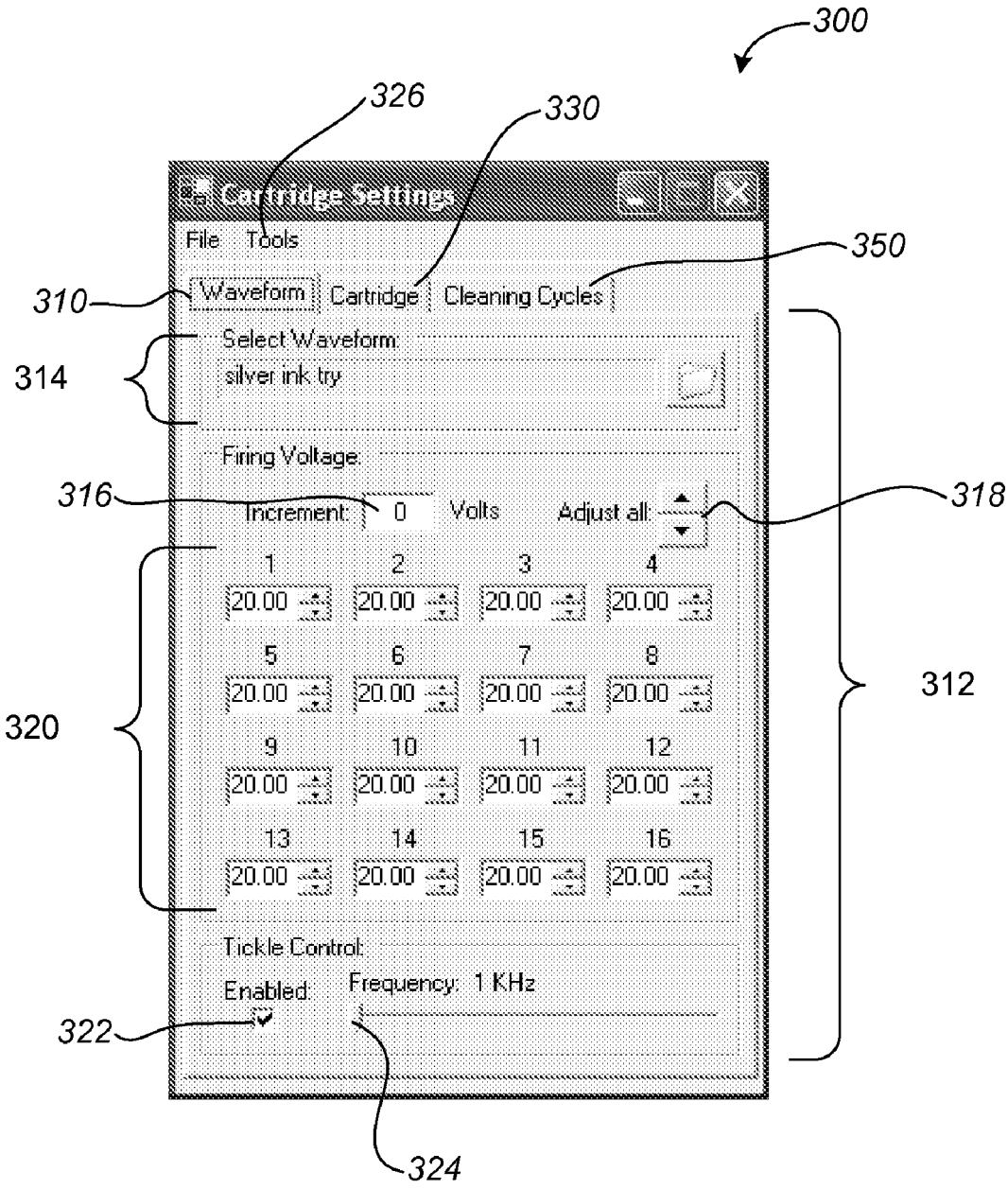
FIG. 11 is a representative screenshot of a Cartridge Settings interface.

FIG. 11 represents a screenshot of one implementation of the cartridge settings editor 300. The user is presented with three GUI tabs 310, 330, and 350, each tab representing a specific editor interface. User selection of a GUI tab labeled "Waveform" 310 can be implemented to display a waveform level interface 312 to facilitate user selection of a predetermined waveform using a "File" search box 314. A list of predetermined waveforms is stored in a folder to provide template waveforms corresponding to a list of identified liquids. When jetting a new liquid of unknown fluid drop ejection characteristics, the user can start with one of the template waveforms and make necessary adjustments to the waveform as described below. The waveform level interface 312 can also be implemented to adjust a voltage level for the selected waveform. The voltage level can be adjusted for all nozzles together in equal stepwise increments by allowing the user to enter a voltage increment in a voltage increment input box 316 and selecting an increase/decrease button 318. Alternately, the voltage level can be adjusted individually for each nozzle by allowing the user to enter a voltage level in multiple voltage input boxes 320, one for each nozzle. In addition, the waveform level interface 312 can be implemented to enable a Tickle Control 322 and adjust a frequency 324 of the Tickle Control.

Figure 12:
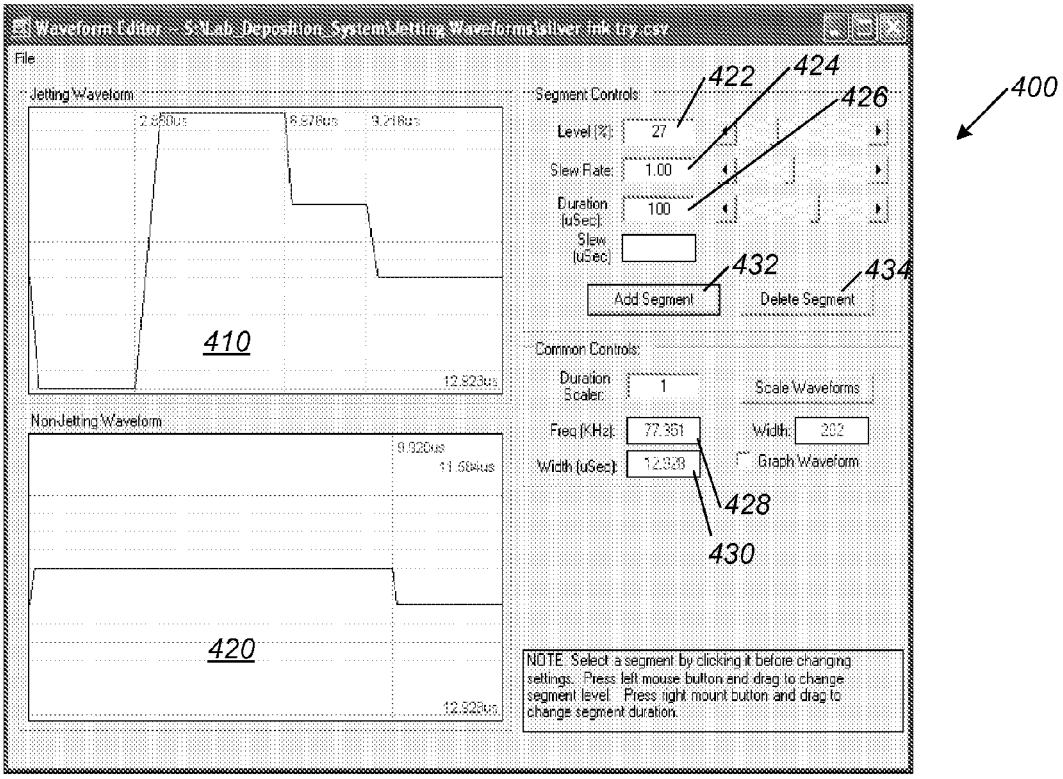
FIG. 12 is a representative screenshot of a Waveform Editor interface.

Once the voltage level has been adjusted by the user, a Waveform Editor 400 as shown in FIG. 12 allows the user to adjust additional waveform parameters. The Waveform Editor 400 can be activated and displayed to the user by a user selection of a "Tools" menu button 326 as shown in FIG. 11 or a "Waveform Editor" button 250 as shown in FIG. 10. A "Jetting Waveform" display 410 and a "Non-Jetting Waveform" display 420 are located on the left side of the Waveform Editor 400. A Jetting Waveform represents a drive pulse applied to the nozzles to effect jetting of a fluid. A Non-Jetting Waveform represents a drive pulse of a lower amplitude than the Jetting Waveform applied to the nozzles to move a meniscus of a fluid drop without effecting jetting of the fluid. Enabling the Tickle Control activates the Non-Jetting Waveform. The user can selectively adjust the waveform parameters for a specific waveform segment by selecting the specific segment of the waveform displayed on the Jetting Waveform display 410 and the Non-Jetting Waveform display 420. User selection of the segment can be performed through a mouse click or drag of the mouse. Once a segment has been selected by the user, any adjustments of % voltage level 422, slew rate 424, duration 426, slew, frequency 428, and width 430 settings are effected on the selected segment. In addition, segments can be added or deleted by selecting "Add Segment" 432 or "Delete Segment" 434 button.

Figure 13:
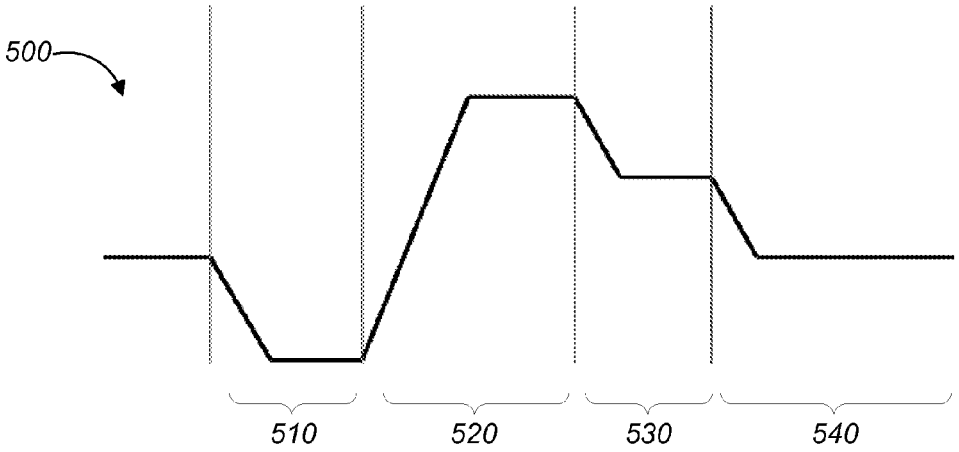
FIG. 13 is a schematic representation of a waveform.

The waveform parameters can be adjusted to match the fluid properties of each different liquid. For a thicker liquid of higher viscosity, the voltage level of the waveform needs to be adjusted to a higher level. Likewise, a steeper slew rate, or rise time of the waveform may be needed. In general, the higher viscosity fluid is less sensitive and provides for a higher frequency performance. A low viscosity fluid requires a lower voltage, a slower rise time and is more sensitive to drive pulse formation. The low viscosity fluid also does not perform as well at high frequencies. FIG. 13 represents an example waveform 500 comprising four segments 510, 520, 530, and 540. The first two segments 510 and 520 have the most significant impact on the drop velocity and formation.

The basic strategy to obtain good drop velocity and good drop formation is to set the voltage to a relatively high level while visually inspecting that the drop formation is acceptable. The drop watcher camera system can be used to observe the drop formation from the nozzles. Then, based on the visual inspection of the drop formation, the first two segments 510 and 520 can be adjusted. The focus is to obtain higher drop velocities while maintaining good drop formation. Reducing the voltage can improve the drop formation, and small adjustments of the last two segments 530 and 540 can provide further improvements in drop formation.

Figure 14:
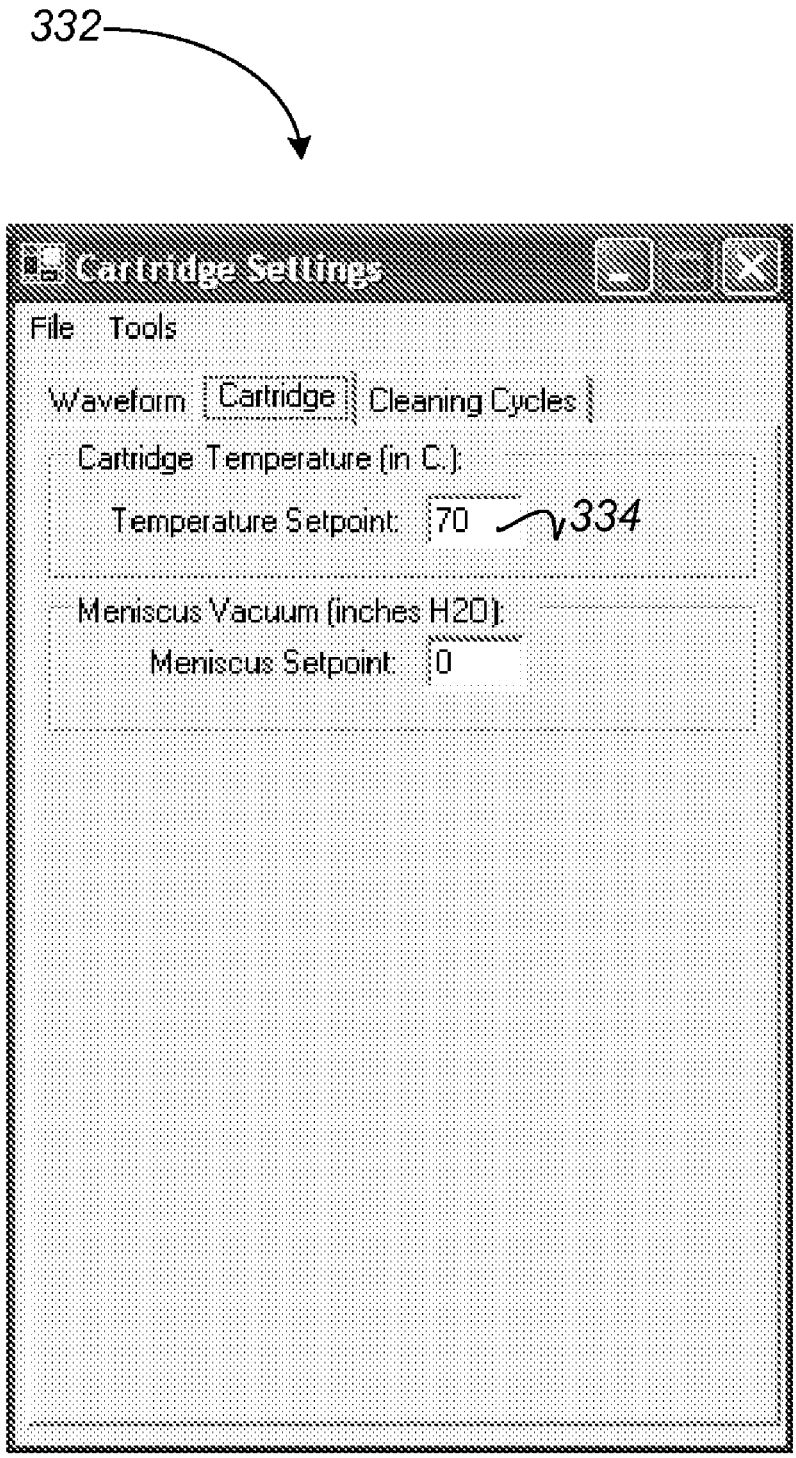
FIG. 14 is a representative screenshot of a Cartridge Settings interface.

Referring back to FIG. 11, a user selection of the next GUI tab, "Cartridge," 330 launches a Cartridge Settings interface 332 (FIG. 14). As described above, if a viscosity of a fluid in the cartridge is too high, the interface can be implemented to adjust the cartridge temperature to a higher level by allowing the user to enter a desired temperature in the cartridge temperature input box 334. An increase in the cartridge temperature effectively increases the temperature of the fluid in the cartridge and decreases the viscosity of the fluid.

Once the waveforms have been created or modified, the waveforms can be stored to the primary controller for use with a deposition system. If multiple types of waveforms are produced, a lookup table can be created for storing the waveforms. The lookup table includes the waveforms as well as identifiers that indicate which waveform corresponds to a desired printing condition or printing parameters.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a tangible program carrier for execution by, or to control the operation of, data processing apparatus. The tangible program carrier can be a propagated signal or a computer readable medium. The propagated signal is an artificially generated signal, e.g., a machine-generated electrical, optical, or electromagnetic signal, that is generated to encode information for transmission to suitable receiver apparatus for execution by a computer. The computer readable medium can be a machine-readable storage device, a machine-readable storage substrate, a memory device, a composition of matter effecting a machine-readable propagated signal, or a combination of one or more of them.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, or declarative or procedural languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described is this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of embodiments have been described. Other embodiments are within the scope of the following claims.

What is claimed is:

1. An assembly of components, comprising:

a circuit board support;

a circuit board comprising electronic logic mounted on the circuit board support, wherein the electronic logic is configurable to receive a definition of a waveform; and a printhead for printing on a substrate, wherein the printhead has actuators that are actuatable according to instructions received from the electronic logic that are based on the definition of the waveform;

wherein the assembly does not include a substrate support.

2. The assembly of claim 1, wherein the assembly includes four printheads, each printhead having a plurality of nozzles and being configured to contain a single ink color or type.

3. The assembly of claim 1, wherein the assembly includes six printheads, each printhead having a plurality of nozzles and being configured to contain a single ink.

4. The assembly of claim 1, wherein the circuit board support comprises alignment features for aligning the assembly in a deposition device.

5. The assembly of claim 1, further comprising a plate to which the printhead is fastened, wherein the plate is removably secured to the circuit board support.

6. An assembly of components, comprising:

a circuit board support;

a circuit board comprising electronic logic mounted on the circuit board support, wherein the electronic logic is configurable to store a plurality of definitions of waveforms; and a printhead for printing on a substrate, wherein the printhead has actuators that are actuatable according to electronic signals received from the electronic logic that are based on the definitions of the waveforms.

7. The assembly of claim 6, wherein the assembly includes four printheads, each printhead having a plurality of nozzles and being configured to contain a single ink.

8. The assembly of claim 6, wherein the assembly includes six printheads, each printhead having a plurality of nozzles and being configured to contain a single ink.

9. The assembly of claim 6, wherein the circuit board support comprises alignment features for aligning the assembly in a deposition device.

10. The assembly of claim 6, further comprising a plate to which the printhead is fastened, wherein the plate is removably secured to the circuit board support.

11. A method of forming a printer, comprising:

receiving a circuit board support, a circuit board comprising a configurable memory and a printhead, wherein the configurable memory is configurable to store a definition of a waveform, and the circuit board support is configured to have the circuit board and the printhead mounted thereon;

loading one or more waveforms onto a master memory;

after loading the one or more waveforms onto the master memory, enclosing an assembly comprising the circuit board support, master memory, circuit board and printhead within a housing so that the master memory is able to communicate with the configurable memory and the configurable memory is able to communicate with the printhead.

12. The method of claim 11, further comprising receiving a waveform and modifying the waveform to be used to jet a desired fluid to create a custom waveform, wherein loading the one or more waveforms onto the master memory comprises loading the custom waveform onto the master memory.

13. A computer program product, encoded on a tangible program carrier, operable to cause a data processing apparatus to perform operations comprising:

displaying a representation of a jetting waveform on a graphical user interface;

receiving user input indicating a selection of a portion of the jetting waveform;

receiving user input indicating a modification of the portion of the jetting waveform selected;

modifying the jetting waveform according to the user input indicating the modification;

adding a modified version of the jetting waveform to a lookup table; and transmitting the lookup table to storage.

14. The computer program product of claim 13, wherein the lookup table includes different waveforms for different sized droplets.

15. A computer program product, encoded on a tangible program carrier, operable to cause a data processing apparatus to perform operations comprising:

displaying a representation of a jetting waveform to a graphical user interface;

receiving user input indicating a selection of a portion of the jetting waveform;

receiving user input indicating a modification of the portion of the jetting waveform selected, wherein the modification defines a drop volume to be ejected; and modifying the jetting waveform according to the user input indicating the modification.

16. The computer program product of claim 15, wherein receiving input indicating the modification of the portion of the jetting waveform comprises receiving input indicating the change in drive voltage.

17. The computer program product of claim 15, wherein receiving input indicating the modification of the portion of the jetting waveform comprises receiving input indicating a change in voltage pulse duration.

18. The computer program product of claim 15, wherein receiving input indicating the modification of the portion of the jetting waveform comprises receiving input indicating a change in slope of the portion of the waveform.

19. The computer program product of claim 15, further comprising sending instructions to a printer, wherein the instructions determine actuation of a printhead.

20. The computer program product of claim 19, wherein sending instructions to the printer includes sending a modified definition of a waveform to storage on the printer and storing the modified definition of the waveform in a lookup table.

* * * * *

UNITED STATES PATENT AND TRADEMARK OFFICE

CERTIFICATE OF CORRECTION

PATENT NO. : 8,056,999 B2
APPLICATION NO. : 12/023483
DATED : November 15, 2011
INVENTOR(S) : Deane A. Gardner et al.

It is certified that error appears in the above-identified patent and that said Letters Patent is hereby corrected as shown below:

Col. 13, line 39:
after “of” delete “the”.

Col. 14, line 42:
after “indicating” delete “the” and insert -- a --.

Signed and Sealed this
Twentieth Day of March, 2012

David J. Kappos

David J. Kappos
*Director of the United States Patent and Trademark Office*